US009932787B2

(12) United States Patent
Suter et al.

(10) Patent No.: US 9,932,787 B2
(45) Date of Patent: Apr. 3, 2018

(54) SYSTEMS AND METHODS FOR MANAGED PRESSURED DRILLING

(71) Applicant: Smith International, Inc., Houston, TX (US)

(72) Inventors: Roger Suter, Katy, TX (US); David Molley, Prairieville, LA (US)

(73) Assignee: SMITH INTERNATIONAL, INC., Houston, TX (US)

( * ) Notice: Subject to any disclaimer, the term of this patent is extended or adjusted under 35 U.S.C. 154(b) by 657 days.

(21) Appl. No.: 14/365,574

(22) PCT Filed: Dec. 14, 2012

(86) PCT No.: PCT/US2012/069628
§ 371 (c)(1),
(2) Date: Jun. 13, 2014

(87) PCT Pub. No.: WO2013/090660
PCT Pub. Date: Jun. 20, 2013

(65) Prior Publication Data

US 2014/0345941 A1 Nov. 27, 2014

Related U.S. Application Data

(60) Provisional application No. 61/570,377, filed on Dec. 14, 2011.

(51) Int. Cl.
*E21B 21/08* (2006.01)
*E21B 34/16* (2006.01)
*E21B 34/10* (2006.01)

(52) U.S. Cl.
CPC ..... *E21B 21/08* (2013.01); *E21B 34/10* (2013.01); *E21B 34/16* (2013.01)

(58) Field of Classification Search
CPC ..... E21B 21/08; E21B 34/10; E21B 34/16
USPC ..... 703/10
See application file for complete search history.

(56) References Cited

U.S. PATENT DOCUMENTS 4,794,534 A * 12/1988 Millheim ..... E21B 44/00 175/40
6,253,787 B1 7/2001 Suter et al.
6,575,244 B2 * 6/2003 Chang ..... E21B 21/08 166/250.01
7,004,448 B2 2/2006 Suter et al.
(Continued)

FOREIGN PATENT DOCUMENTS

WO 00/04269 1/2000

OTHER PUBLICATIONS

Examination Report issued in CA2859389 dated Jul. 9, 2015, 3 pages.

(Continued)

*Primary Examiner* — Blake Michener
(74) *Attorney, Agent, or Firm* — David J. Smith

(57) ABSTRACT

Stable back pressure control devices are used to control fluid pressure in a wellbore to provide constant downhole pressure. Back pressure may be estimated from a correlation between the speed of a mud pump and the pressure exerted from the pump. Drilling plans disclosed herein provide for the continued operation of one or more back pressure control devices for providing constant bottomhole pressure when casing connections are being made.

16 Claims, 7 Drawing Sheets

(56) References Cited

U.S. PATENT DOCUMENTS

| | | | | |
|---|---|---|---|---|
| 7,363,937 | B2 | 4/2008 | Suter et al. | |
| 7,478,672 | B2 | 1/2009 | Rogers et al. | |
| 8,099,266 | B2 * | 1/2012 | Burge | E21B 44/00 700/28 |
| 8,281,875 | B2 | 10/2012 | Lovorn et al. | |
| 8,490,719 | B2 * | 7/2013 | Duhe | E21B 21/08 166/250.07 |
| 8,727,783 | B2 * | 5/2014 | Chen | G09B 19/24 175/24 |
| 8,892,407 | B2 * | 11/2014 | Budiman | E21B 47/022 703/10 |
| 2003/0024737 | A1 * | 2/2003 | Chang | E21B 21/08 175/25 |
| 2003/0168258 | A1 | 9/2003 | Koederitz | |
| 2003/0196804 | A1 * | 10/2003 | Riet | E21B 21/08 166/267 |
| 2004/0144565 | A1 * | 7/2004 | Koederitz | E21B 21/08 175/25 |
| 2005/0092523 | A1 | 5/2005 | McCaskill et al. | |
| 2006/0207795 | A1 * | 9/2006 | Kinder | E21B 21/08 175/38 |
| 2007/0151762 | A1 * | 7/2007 | Reitsma | E21B 21/08 175/40 |
| 2007/0227774 | A1 | 10/2007 | Reitsma et al. | |
| 2007/0235223 | A1 * | 10/2007 | Tarr | E21B 21/08 175/7 |
| 2008/0060846 | A1 * | 3/2008 | Belcher | E21B 17/042 175/25 |
| 2009/0063055 | A1 | 3/2009 | Schneider et al. | |
| 2009/0090555 | A1 | 4/2009 | Boone et al. | |
| 2009/0194330 | A1 * | 8/2009 | Gray | E21B 21/00 175/24 |
| 2009/0260698 | A1 | 10/2009 | Suter | |
| 2011/0042076 | A1 * | 2/2011 | Reitsma | E21B 21/08 166/250.01 |
| 2011/0172976 | A1 * | 7/2011 | Budiman | E21B 47/04 703/2 |
| 2011/0266056 | A1 * | 11/2011 | Pop | E21B 49/08 175/50 |
| 2012/0048620 | A1 * | 3/2012 | Hopwood | E21B 21/08 175/38 |
| 2012/0219933 | A1 * | 8/2012 | Chen | G09B 19/24 434/219 |
| 2012/0221308 | A1 * | 8/2012 | Chen | G09B 9/00 703/10 |

OTHER PUBLICATIONS

International Search Report of PCT Application Serial No. PCT/US2012/069628 dated Mar. 28, 2003 (4 pages).

Extended European Search Report for corresponding European Application Serial No. 12857326.8, dated Feb. 11, 2016, 9 pages.

* cited by examiner

SYSTEMS AND METHODS FOR MANAGED PRESSURED DRILLING

BACKGROUND

There are many applications in which there is a need to control the back pressure of a fluid flowing in a system. For example, in the drilling of oil and gas wells it is customary to suspend a drill pipe in the wellbore with a bit on the lower end thereof and, as the bit is rotated, to circulate a drilling fluid, such as a drilling mud, down through the interior of the drill string, out through the bit, and up the annulus of the wellbore to the surface. Traditional drilling practices rely on pressure created by the drilling mud as it circulates through the drillstring to prevent formations fluids from entering the wellbore. Ideally, this equivalent circulating density (ECD) is greater than the pore pressure but less than the fracture gradient of the formations being drilled. ECD is the effective density exerted by a circulating fluid against the formation. As the ECD approaches or exceeds the fracture gradient, casing must be set to prevent fracturing the formation. As the ECD approaches or goes below the pore pressure, increasing the drilling mud density or adding back pressure is required to manage or prevent formation flow. Thus, in some instances, a back pressure control device is mounted in the return flow line for the drilling fluid.

Back pressure control devices are also necessary for controlling "kicks" in the system caused by the intrusion of salt water, formation fluids orgases into the drilling fluid which may lead to a blowout condition. In these situations, sufficient additional back pressure must be imposed on the drilling fluid such that the formation fluid is contained and the well controlled until heavier fluid or mud can be circulated down the drill string and up the annulus to kill the well. It is also desirable to avoid the creation of excessive back pressures which could cause the drill string to stick, or cause damage to the formation, the well casing, or the well head equipment.

Mud weight is the primary means of pressure control. During drilling, the annular pressure profile is preferably maintained between the pore pressure and the fracture pressure. Pore pressure is defined as the pressure being exerted into the wellbore by fluids or gases within the pore spaces of the formation (also known as the formation pressure). Fracture gradient is defined as the pressure required to physically rupture the formation and cause fluid losses. Maintaining the fluid pressure between the pore and fracture pressures should provide a stable well, i.e., no fluid intrusion into the wellbore (a kick) or formation breakdown. The area located between the pore and fracture pressures is called the well stability window.

However, maintenance of an optimum back pressure on the drilling fluid is complicated by variations in certain characteristics of the drilling fluid as it passes through the back pressure control device. For example, the density of the fluid can be altered by the introduction of debris or formation gases, and/or the temperature and volume of the fluid entering the control device can change. Therefore, the desired back pressure will not be achieved until appropriate changes have been made in the throttling of the drilling fluid in response to these changed conditions. Conventional devices, such as a choke, generally require manual control of and adjustments to the back pressure control device orifice to maintain the desired back pressure.

In conventional drilling, annular pressure is primarily controlled by mud density and mud pump flow rates. When the mud pumps are off, a column of mud exerts hydrostatic pressure on the formation. When the mud pumps are on, the circulating fluid exerts a frictional pressure on the formation in addition to the hydrostatic pressure. These combined pressures can be expressed as a density in pounds per gallon (ppg) as the equivalent circulating density (ECD) at any depth in the well.

In conventional drilling, wellbore stability is maintained by manipulating the static and dynamic pressure profile of the annular fluid through control of fluid density, viscosity and pumping rates. During static times (pumps off) the fluid pressure should be greater than the pore pressure but less than the fracture pressure. If the wellbore stability window is too narrow, conventional techniques become technically impossible or uneconomical to use.

Accordingly, there exists a need for a method for operating the drilling process within narrow wellbore stability windows by controlling the annular pressure profile within a subterranean borehole.

DETAILED DESCRIPTION

Embodiments herein describe a managed pressure drilling method. The method defines a drilling plan for a first section of wellbore and determines a desired drilling pressure for the first section. The method determines a pump speed and a corresponding choke set point for producing the desired drilling pressure for the first segment of the drilling plan.

Embodiments herein also describe well drilling method. The method includes drilling a first segment according to a drilling plan and maintaining a near constant bottom hole pressure via a choke assembly which provides a back pressure and a mud pump which provides a downhole pressure. The downhole pressure is correlated to a pump speed and the choke assembly is operated to provide the back pressure. The back pressure substantially is the downhole pressure subtracted from the bottom hole pressure.

Figure 1:
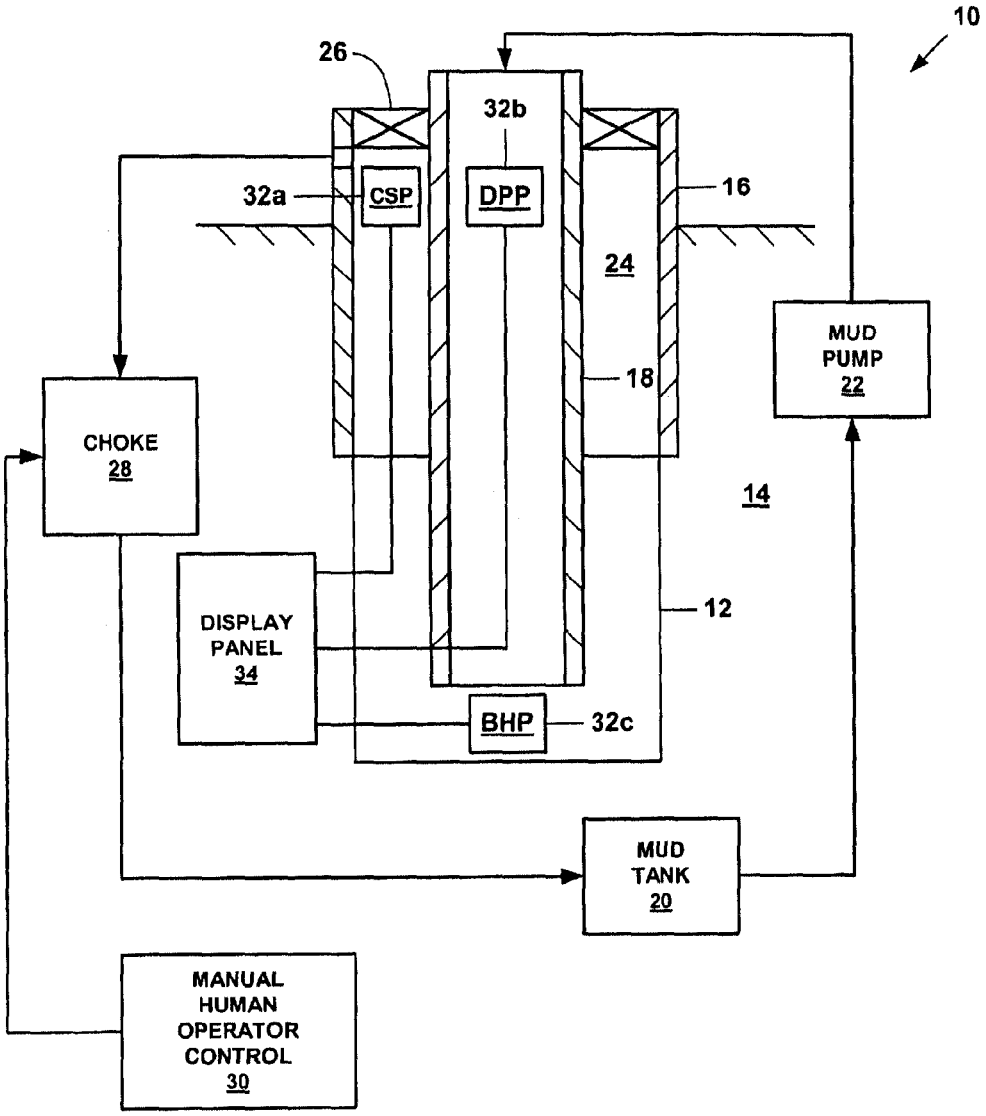
FIG. 1 is a schematic illustration of an embodiment of a conventional oil or gas well.

Referring to FIG. 1, a typical oil or gas well 10 includes a wellbore 12 that traverses a subterranean formation 14 and includes a wellbore casing 16. During drilling of the well 10, a drill pipe 18 may be positioned within the wellbore 12 in order to inject fluids such as, for example, drilling mud into the wellbore. As will be recognized by persons having ordinary skill in the art, the end of the drill pipe 18 may include a drill bit and the injected drilling mud may be used to cool the drill bit and remove particles away drilled by the drill bit. A mud tank 20 containing a supply of drilling mud may be operably coupled to a mud pump 22 for injecting the drilling mud into the drill pipe 18. The annulus 24 between the wellbore casing 16 and the drill pipe 18 may be sealed in a conventional manner using, for example, a rotary seal 26.

In order to control the operating pressures within the well 10 such as, for example, within acceptable ranges, a choke 28 in fluid communication with the annulus 24 between the wellbore casing 16 and the drill pipe 18 in order to controllably bleed off pressurized fluidic materials out of the annulus 24 back into the mud tank 20 to thereby create back pressure within the wellbore 12.

The choke 28 is manually controlled by a human operator 30 to maintain one or more of the following operating pressures within the well 10 within acceptable ranges: (1) the operating pressure within the annulus 24 between the wellbore casing 16 and the drill pipe 18—commonly referred to as the casing pressure (CSP); (2) the operating pressure within the drill pipe 18—commonly referred to as the drill pipe pressure (DPP); and (3) the operating pressure within the bottom of the wellbore 12—commonly referred to as the bottom hole pressure (BHP). In order to facilitate the manual human control 30 of the CSP, the DPP, and the BHP, sensors, 32*a*, 32*b*, and 32*c*, respectively, may be positioned within the well 10 that provide signals representative of the actual values for CSP, DPP, and/or BHP for display on a conventional display panel 34. Typically, the sensors, 32*a* and 32*b*, for sensing the CSP and DPP, respectively, are positioned within the annulus 24 and drill pipe 18, respectively, adjacent to a surface location. The operator 30 may visually observe one of the more operating pressures, CSP, DPP, and/or BHP, using the display panel 34 and attempt to manually maintain the operating pressures within predetermined acceptable limits by manually adjusting the choke 28. If the CSP, DPP, and/or the BHP are not maintained within acceptable ranges, fluid loss and/or an underground blowout may occur thereby potentially damaging the production zones within the subterranean formation 14.

Back pressure control systems useful in embodiments disclosed herein may include those described in, for example, U.S. Pat. Nos. 7,004,448 and 6,253,787, U.S. Patent Application Publication No. 20060011236, and U.S. patent application Ser. No. 12/104,106 (assigned to the assignee of the present application), each of which is incorporated herein by reference.

Figure 2:
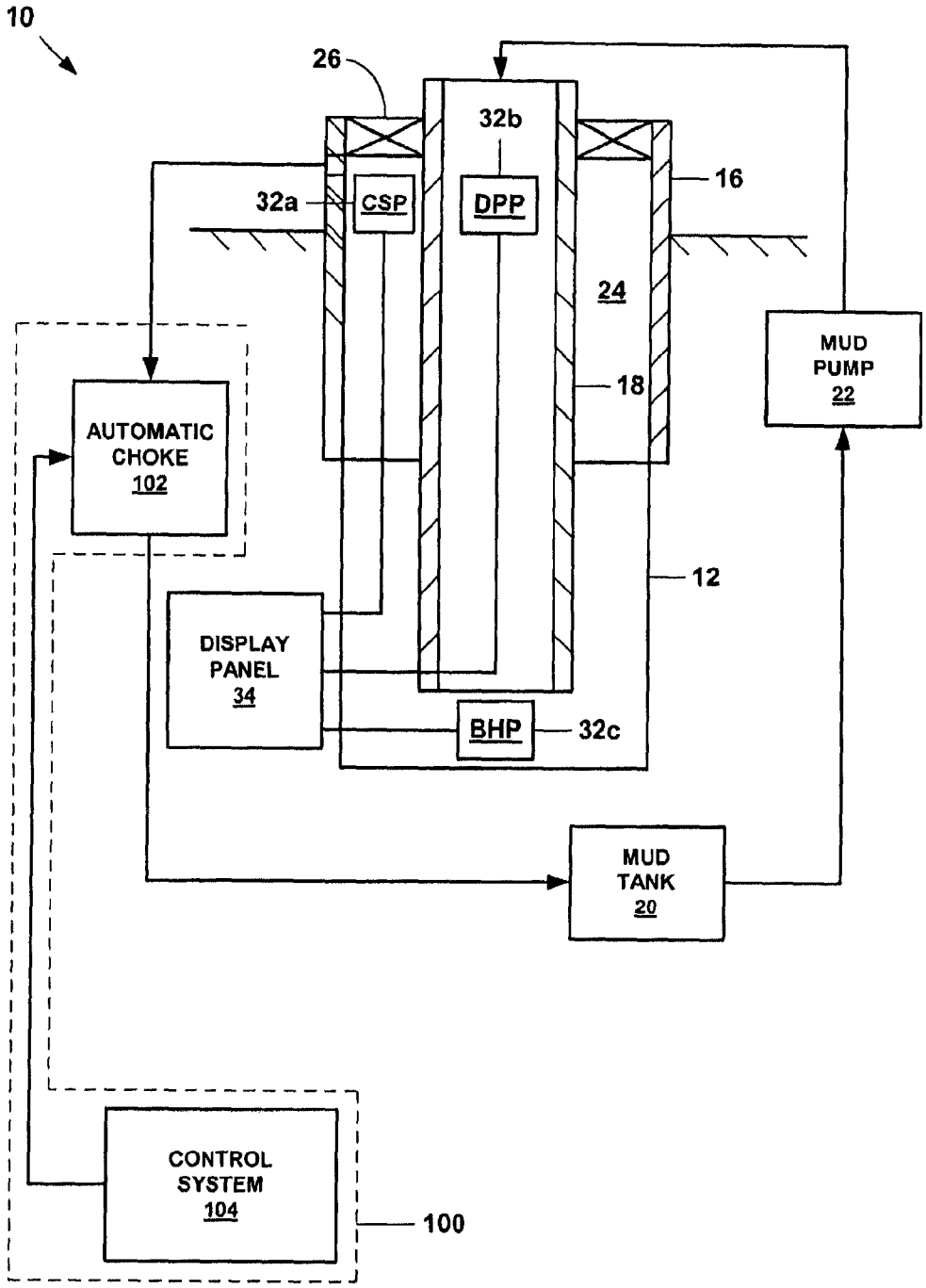
FIG. 2 is a schematic illustration of an embodiment of a system for controlling the operating pressures within an oil or gas well.
Figure 3:
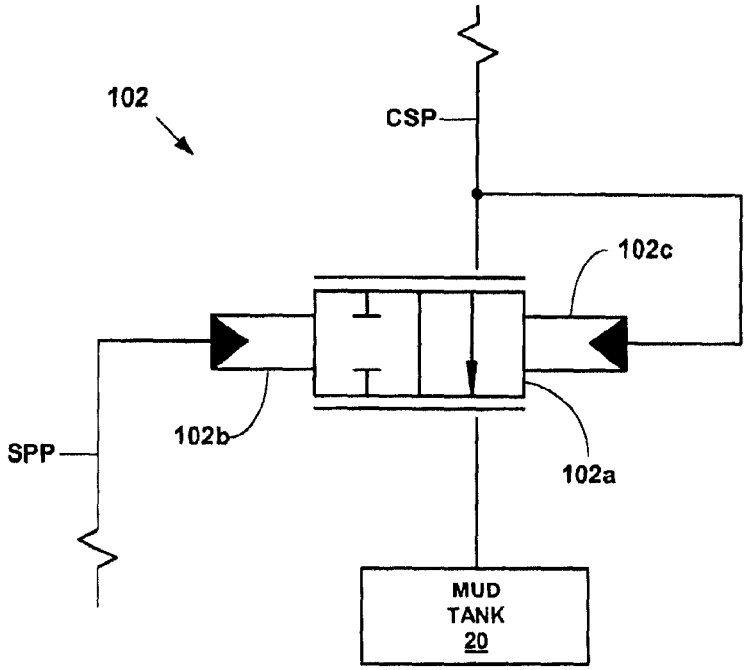
FIG. 3 is a schematic illustration of an embodiment of the automatic choke of the system of FIG. 2.
Figure 4:
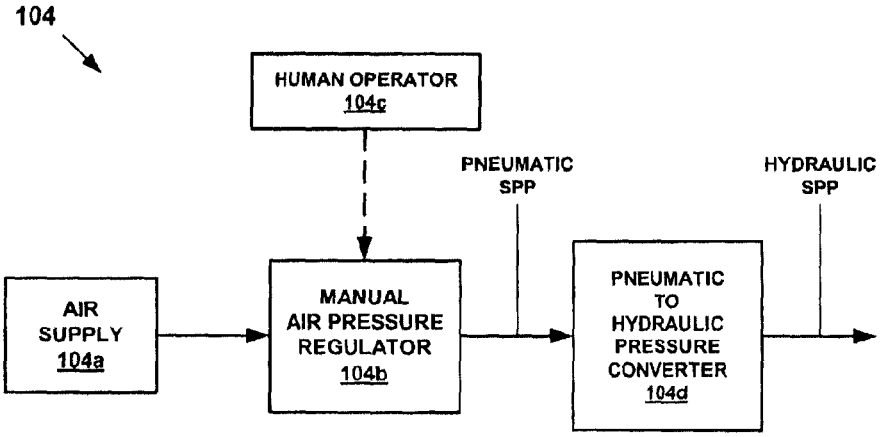
FIG. 4 is a schematic illustration of an embodiment of the control system of the system of FIG. 2.

Referring to FIGS. 2-4, the reference numeral 100 refers, in general, to an embodiment of a system for controlling the operating pressures within the oil or gas well 10 that includes an automatic choke 102 for controllably bleeding off the pressurized fluids from the annulus 24 between the wellbore casing 16 and the drill pipe 18 to the mud tank 20 to thereby create back pressure within the wellbore 12 and a control system 104 for controlling the operation of the automatic choke. In some embodiments, the automatic choke 102 may also be operated manually.

As illustrated in FIG. 3, the automatic choke 102 includes a movable valve element 102*a* that defines a continuously variable flow path depending upon the position of the valve element 102*a*. The position of the valve element 102*a* is controlled by a first control pressure signal 102*b*, and an opposing second control pressure signal 102*c*. In an exemplary embodiment, the first control pressure signal 102*b* is representative of a set point pressure (SPP) that is generated by the control system 104, and the second control pressure signal 102*c* is representative of the CSP. In this manner, if the CSP is greater than the SPP, pressurized fluidic materials within the annulus 24 of the well 10 are bled off into the mud tank 20. Conversely, if the CSP is equal to or less than the SPP, then the pressurized fluidic materials within the annulus 24 of the well 10 are not bled off into the mud tank 20. In this manner, the automatic choke 102 provides a pressure regulator than can controllably bleed off pressurized fluids from the annulus 24 and thereby also controllably control back pressure in the wellbore 12. In an exemplary embodiment, the automatic choke 102 is further provided substantially as described in U.S. Pat. No. 6,253,787, the disclosure of which is incorporated herein by reference.

As illustrated in FIG. 4, the control system 104 includes a conventional air supply 104*a* that is operably coupled to a conventional manually operated air pressure regulator 104*b* for controlling the operating pressure of the air supply. A human operator 104*c* may manually adjust the air pressure regulator 104*b* to generate a pneumatic SPP. The pneumatic SPP is then converted to a hydraulic SPP by a conventional pneumatic to hydraulic pressure converter 104*d*. The hydraulic SPP is then used to control the operation of the automatic choke 102. In other embodiments, the control system 104 may be an electronic control system.

Thus, the system 100 permits the CSP to be automatically controlled by the human operator 104*c* selecting the desired SPP. The automatic choke 102 then regulates the CSP as a function of the selected SPP.

The above systems may be used to control the operating pressure within a narrow well stability window using one or more Managed Pressure Drilling (MPD) techniques. Managed pressure drilling techniques use a collection of tools to hold back pressure and more precisely controls the annular pressure profile. In a preferred embodiment, a managed pressure drilling technique known as the Constant Bottom Hole Pressure Profile method may be used, particularly during casing connections. In this method, by applying back pressure during connections (pumps off) a constant BHP is achieved. Managed pressure drilling methods depend upon keeping the wellbore closed at all times. Back pressure can also be held during the drilling phase (pumps on) to provide additional pressure control on the well.

Figure 5A:
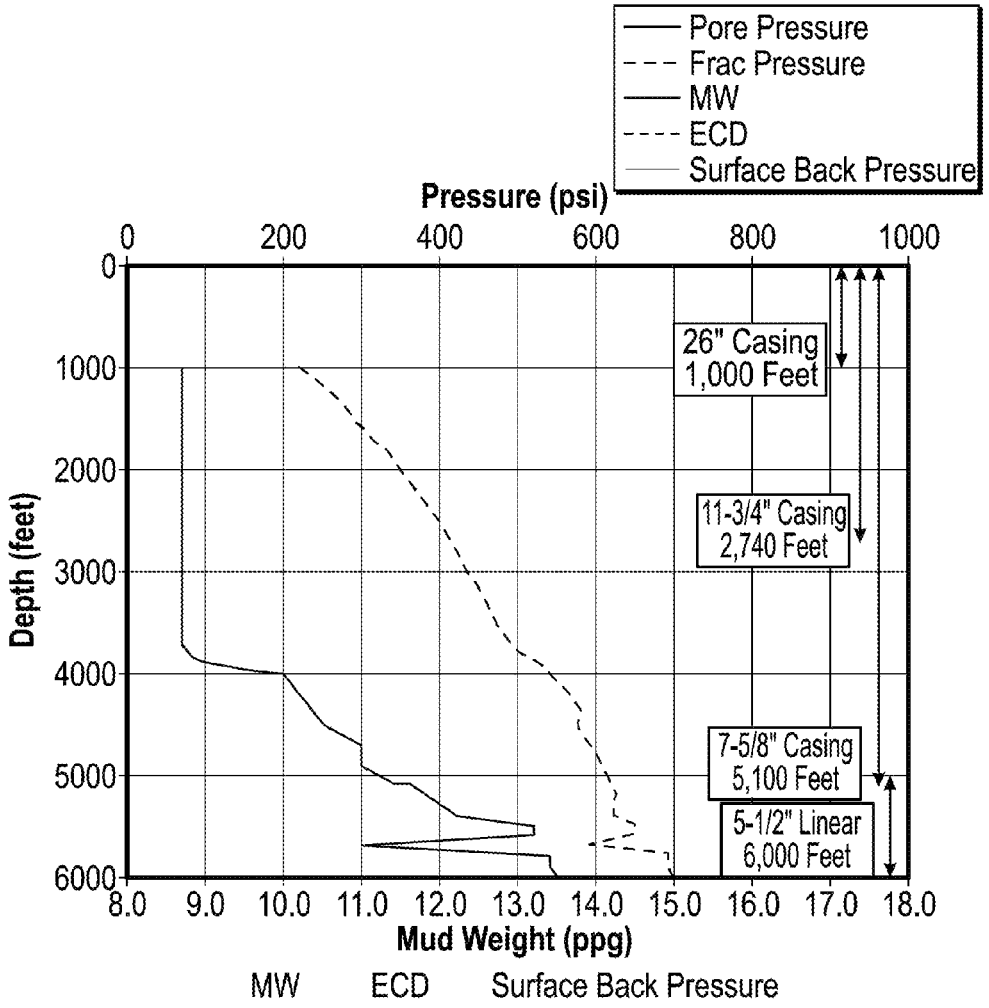
FIG. 5A is a graphical illustration of an embodiment of a pore and fracture pressure graph for an oil or gas well.

Managed pressure drilling techniques involve the use of a pressure profile for a specific well. Referring to FIG. 5A, an exemplary pressure profile comprises a pore and fracture pressure graph. The graph includes depth in feet along the left vertical axis, which starts at zero depth, corresponding to the surface and extends to 6000 feet deep (in this exemplary embodiment). Pressure in pounds per square inch (psi) is shown along the top horizontal axis and starts at zero and increases to 1000 psi. The mud weight (MW) in pounds per gallon (ppg) is shown along the bottom horizontal axis and starts at 8.0 ppg and increase to 18.0 ppg (in this embodiment). This graph will be different for every well drilled. In this embodiment, there are five (5) variables shown: Pore Pressure, Fracture Pressure, Mud Weight (MW), Equivalent Circulating Density (ECD) and Surface Back Pressure. These variables may be used to define drilling plans for various sections of the well.

By plotting the pore pressure and the fracture pressure, a well stability window can be defined as the area between the pore and fracture pressures. Connections are made to add pipe to the drill string. To make the connection, the mud pumps must be turned off, the connection made, and the mud pumps restarted. Mud weight is the primary means of pressure control and the drilling engineer will determine the mud weight necessary for each segment of the drilling plan. Using the pore pressure graph, a drilling plan can be defined for each of the segments. The drilling plan typically sets forth equipment, pressures, trajectories and/or other parameters that define the drilling process for the borehole. The drilling process may then be performed according to the drilling plan. However, as information is gathered, the drilling operation may deviate from the drilling plan. Additionally, as drilling or other operations are performed, the subsurface conditions may change. The drilling plan may also be adjusted as new information is collected. The drilling plan may be used to determine a desired drilling pressure for the various segments of the well. The desired drilling pressure may be any pressure within the well stability window. The data in the pore pressure graph may be historical data, may be simulated, or may be calculated using an algorithm for predicting drilling properties. Simulation of the pore pressure graph may be done by computer modeling programs for drilling operations.

Figure 5B:
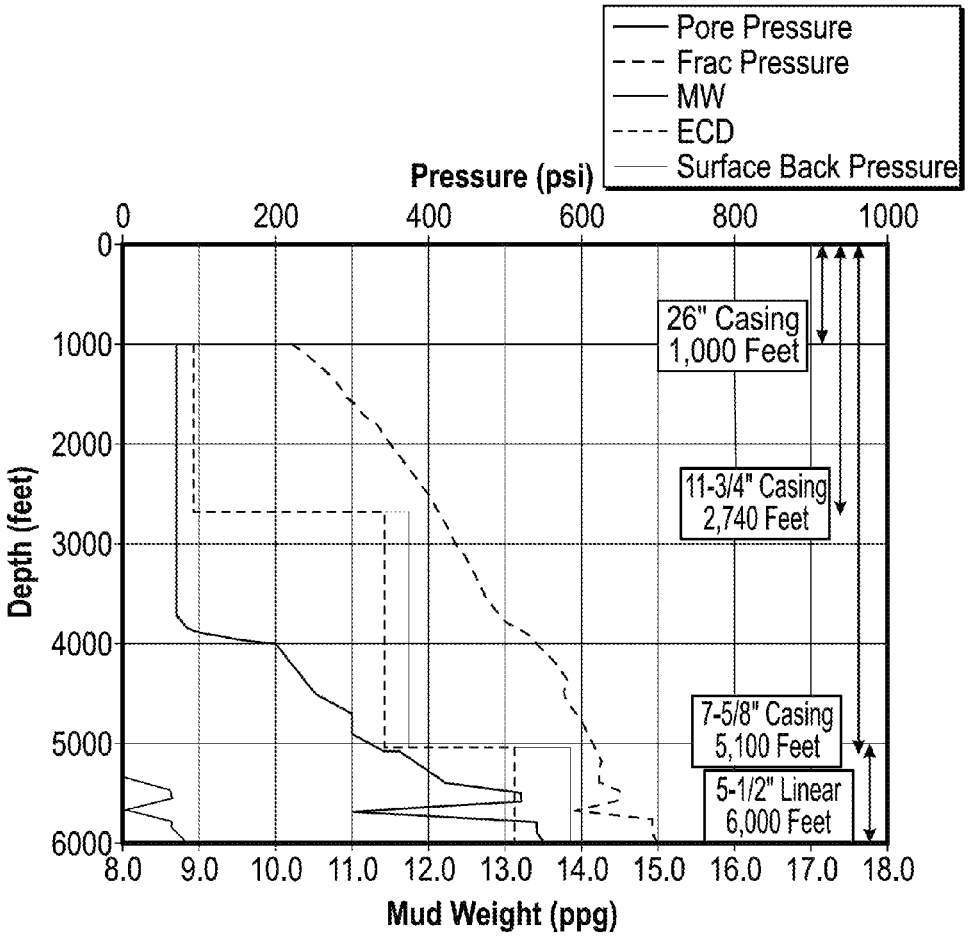
FIG. 5B is a graphical illustration of an embodiment of a pressure profile showing the desired drilling pressure of an oil or gas well.

Referring to FIG. 5B, when the mud pumps are running, the annular friction pressure adds to the mud weight fluid hydrostatic pressure. These combined pressures can be expressed in pounds per gallon (ppg) as the ECD (Equivalent Circulating Density) at any depth in the well. In some embodiments, the mud weight fluid hydrostatic pressure is above the pore pressure and provides pressure control during static times (pumps off), but when the mud pump is turned on, the ECD may be above the fracture pressure increasing the chance for wellbore fracture and/or lost circulation. Reducing the static fluid pressure (mud weight) will keep the ECD below the fracture pressure when the pumps are running. However, when the mud pumps are off there is an increased chance for a kick from a permeable zone. By trapping back pressure during connections (pumps off) a near constant BHP can be achieved. The back pressure will increase the BHP. Back pressure may be applied via a choke and back pressure can be held constant during the drilling phase (pumps on) to provide additional pressure control on the well. "Near constant" allows for slight variations in the pressure. The variations may be ±1%, ±2%, ±5%, or ±10%

In some embodiments, it may be desired to have the ability to control the back pressure (choke) control systems locally, proximate the location of the back pressure control system, or remotely. The chokes described according to embodiments disclosed herein may be associated with operating panels, similar to those described in U.S. Patent Application No. 2006/0201671, which is incorporated herein by reference, including a remote operating panel and a local operating panel, which may be proximate to the back-pressure control system. The remote operating panel, for example, may receive data from at least one remotely located wellbore sensor. The remote operating panel may include: a plurality of operator controls located on the housing for controlling operation of the back pressure control system and a display located on the housing for visually displaying values of data received from the wellbore sensor. The local operating panel may be in electronic communication with the remote operating panel. The local operating panel may include a local operator controller having an operator interface for receiving operator instruction input into the local panel and operable to receive operator instructions from the remote panel and transmit operator instructions. In other embodiments, a Human Machine Interface may be used to control the back pressure (choke) control systems.

In some embodiments, such as to meet classifications for hazardous environments, the above described remote and local operating panels may include a housing within which the controls are located, including one or more of speed dials, open/close levers, a contrast, a stroke reset switch, analog gauges, a digital display, and other components useful for operation of the pressure control apparatus. The operating panels may also include a plurality of electronic inputs to provide input of electronic data from one or more sensor communication cables and/or one or more sensors. A panel communication cable may connect the local panel to the remote panel electronically.

One or more sensors are generally located within the wellbore to measure predetermined parameters. In one embodiment, sensor communication cables connect the sensors and the local panel. In one embodiment, the remote actuator panel includes preprogrammed algorithms operative to interpret measurement data and transmit responsive instruction to control fluid pressure control systems. In one embodiment, wherein the local panel includes an emergency stop button, instructions from the remote actuator panel are routed through the local panel because the emergency stop cannot be bypassed. In one embodiment, the local panel includes preprogrammed algorithms operative to interpret measurement data and transmit responsive instruction to control fluid pressure control systems.

The operator is provided with three methods of control. The first method is electronically through the use of the remote panel from a remote location such as the doghouse. The second method is electronically and allows the operator to control the back pressure control system from the local panel. The final method of control is mechanical by using manual controls coupled to the control fluid pressure control system. All of the electronic components should be provided for hazard area use. Examples of methods which render the electronics for hazard area use include, but are not limited to, purging, encapsulation, or combinations thereof.

In some embodiments, a remote panel may be in electronic communication with a plurality of local panels located respectively proximate a plurality of back pressure control systems. Alternatively, embodiments may include a plurality of remote panels that are in electronic communication with a local unit whereby a single remote panel controls the local panel and the other remotes are allowed to monitor the local panel. The remote panels may include a graphical touch screen. The remote panels may be networked into a rig-wide system that may also include an internet connection allowing remote panels to be located off-site, such as a remote office anywhere in the world. In some embodiments, the remote panel may include a selection switch on the panel to toggle operational control between two or more detent locations corresponding to the two or more control fluid pressure control systems. In other embodiments, the panels may be designed for concurrent control of two or more back pressure control systems without the need for a toggle switch.

In some embodiments, apparatus for controlling back pressure control systems described herein may additionally provide for advanced control of the system components, such as via a proportional-integral-differential (PID) controller, such as described in, for example, U.S. Pat. No. 6,575,244, which is incorporated herein by reference.

To maintain the ECD within the well stability window during connections, a trapped pressure technique may be used. The trapped pressure refers to the bottom hole pressure. To maintain a near constant bottom hole pressure, the mud pump speed is ramped down while the choke is closed to trap pressure in the annulus. By lowering the speed of the pump, the ECD is reduced. By closing the choke, the back pressure is increased. After the connection is made this process is reversed. To maintain near constant bottom hole pressure, the choke operator and the mud pump operator must work in tandem to lower pump speed while increasing choke pressure. Success of the connections depends on the skill of both the mud pump operator and the choke operator. In some embodiments, the pressure profile may be used to guide both the mud pump operator and the choke operator.

In another embodiment, a pressure profile table of pump rates and casing pressure targets may be used by the mud pump operator and the choke operator to guide the operation and thereby provide a more stable bottom hole pressure operation. In some embodiments, the pressure profile table of pump rates and casing pressure targets may be entered into a Low Pressure AutoChoke Console (LPAC) available from M-I L.L.C. (Houston, Tex.), which will control the casing pressure according to the table entries.

The pressure profile table of pump rates and casing pressure targets may be acquired from the drilling engineer or determined by the following method. A target bottom hole pressure is determined from offset well parameters. Some examples of offset well parameters include but are not limited to pore pressure, fracture gradient, mud weight, depth of well, casing pressure and/or type, etc. To maintain the target bottom hole pressure, the pressure from the choke and the mud pump speed must be balanced. The mud pump speed can be correlated to an equivalent circulating density (ECD) pressure from various sensors throughout the well for various speeds of the pump. For example, at a maximum speed of the mud pump, the equivalent ECD pressure can be determined. The speed of the mud pump will be lowered to another setting and the corresponding equivalent ECD pressure tabulated. This procedure will be repeated until a table (or graph) can be made for the entire range of the pump speed, maximum to off (zero). The target casing pressure is calculated, by subtracting the equivalent ECD pressure from the target BHP. The target casing pressure may be used during operation of the choke to provide a set point for maintaining near constant bottom hole pressure.

An example of a pressure profile table is shown below:

TABLE I

| Pressure Profile | | |
|---|---|---|
| Maximum Dynamic BHP Increase at Drilling Rate (psig) | | 415 Casing |
| Rig Pump Speed (spm) | ECD Pressure (psig) | Pressure (psig) |
| 70 | 390 | 25 |
| 61 | 310 | 105 |
| 53 | 215 | 200 |
| 35 | 90 | 325 |
| 0 | 0 | 415 |

Figure 6:
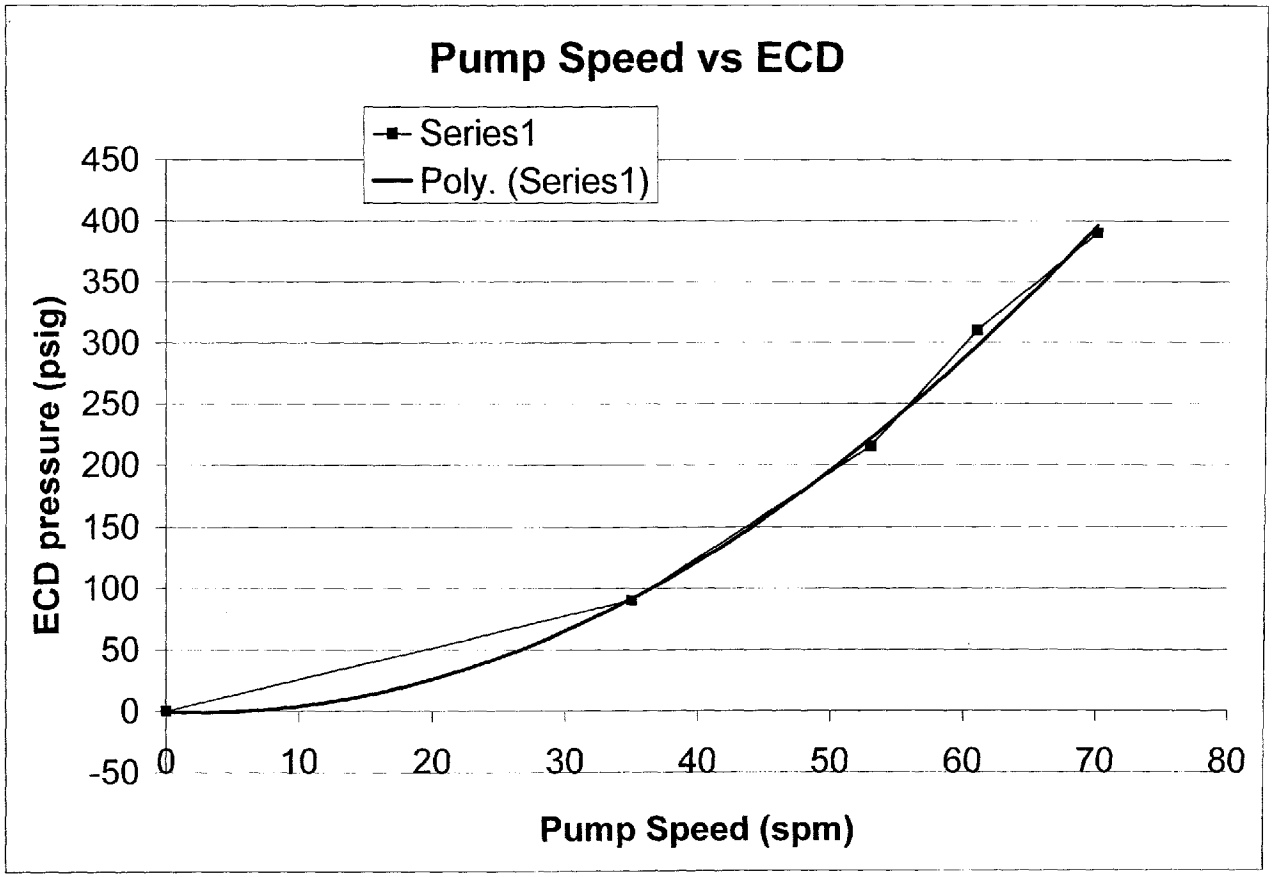
FIG. 6 is a graphical illustration of a pump rate vs Equivalent Circulating Density table.

The data may also be shown in graphical form, as shown in FIG. 6. In alternate embodiments, the pressure profile table may be simulated using drilling parameters from nearby installations or based on historical data. The simulation may be provided by a drilling simulation model. The drilling simulation model may be provided by a computer program. Alternatively, the table of mud pump speed vs. ECD pressures may be applied to a mathematical curve-fit function providing a mathematical function which allows an ECD to be calculated for any mud pump speed within the range tested, thus the resulting mathematical function replaces the pressure profile table. FIG. 6 can be produced using the any of the above models or procedures.

Once the pressure profile table of pump rates and casing pressure targets is known, the drilling of the well may commence according to a drilling plan, such as that shown in FIG. 5B. In a particular embodiment, the following drilling plan may be performed for making a connection using the pressure profile of Table I.

In another embodiment, the above process may be augmented by a computer system. Referring again to Table II, to make a connection during drilling with the pump operating at maximum speed, i.e., 70 spm (strokes per minute), the pump speed is set to 61 spm which correlates to an equivalent ECD pressure of 310 psig, meaning a casing pressure of 105 psi must be provided to achieve the target bottom hole pressure. The computer system monitors the pump speed and when it sees the pump speed begin to reduce to 61 spm it sets the choke setpoint pressure (SPP) to a value according to the pressure profile algorithm and mathematical function mentioned earlier. When the pump speed reduces to 61 psi, the computer controlled set point pressure should be 105 psi +– a small curvfit error. This automatic calculating and setting of the choke set point pressure will continue for each of the stages until the pump speed of 35 spm is reached. When the desired pump speed is reached, the computer system will rapidly increase the choke set point pressure (SPP) until the choke fully closes. When the choke is fully closed, the computer system will then signal the choke operator to shut off the mud pumps, trapping pressure behind the choke. The connection will then be made. Once the connection is made, the pump operator will reverse the procedure and start the pump at 35 spm. The computer system will detect that pump speed has started and set the choke set point pressure (SPP) to 335 psi. As the pressure increases, the computer system will calculate the required choke set point pressure (SPP) according to the pressure profile algorithm and mathematical function mentioned earlier and set the choke set point pressure accordingly. Once a pump speed of 70 spm is reached the computer system will set the choke set point pressure to 0 psi and it will remain at this pressure until the next connection is made.

In some embodiments, the BHP may be monitored in real time. If the BHP is monitored in real time, the information may be used to generate a pressure profile table, such as Table 1. In other embodiments, when monitoring the BHP in real time, the BHP may automatically set the SPP to hole it at or near a predetermined value. In other embodiments, pressure may be automatically trapped if mud pumps are lost, i.e., power failure, etc.

TABLE II

| Drilling Plan for Constant Bottom Hole Pressure | | | |
|---|---|---|---|
| Rig Pump Speed (spm) | Casing Pressure (psig) | SPP (psig) | Choke Operator & Driller Timing |
| 70 | 25 | zero | |
| 61 | 105 | 105 | simultaneous |
| 53 | 200 | 200 | simultaneous |
| 35 | 325 | 335 | simultaneous |
| prepare to trap pressure | | | Driller lags Choke |
| 0 | 415 | 435 | |
| MAKE CONNECTION | | | |
| 0 | 415 | 435 | |
| increasing from zero (unseat AutoChoke) | | 260 | simultaneous |
| 35 | 325 | 335 | simultaneous |

TABLE II-continued

| Drilling Plan for Constant Bottom Hole Pressure | | | |
|---|---|---|---|
| Rig Pump Speed (spm) | Casing Pressure (psig) | SPP (psig) | Choke Operator & Driller Timing |
| 53 | 200 | 200 | simultaneous |
| 61 | 105 | 105 | simultaneous |
| 70 | 25 | zero | simultaneous |

Figure 7:
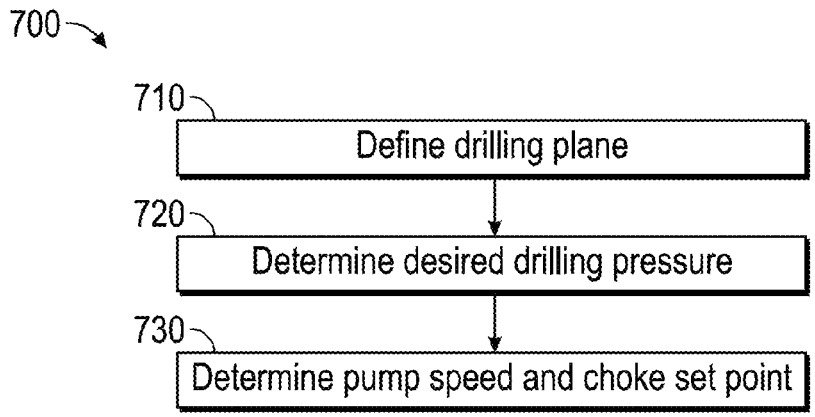
FIG. 7 is a schematic flowchart of an embodiment of a method of using the system of FIG. 2.

Referring to FIG. 7, embodiments the present disclosure may be used for a managed pressure drilling method 700. The method 700 includes the steps of defining a drilling plan for a segment of wellbore 710 and determining a desired drilling pressure for the drilling plan 720. A pump speed and a corresponding choke set point to produce the desired drilling pressure of the drilling plan may then be determined 730. Alternatively, a computer may be programmed to change the setpoint pressure automatically according to the pressure profile as the pump speed changes during a connection.

Figure 8:
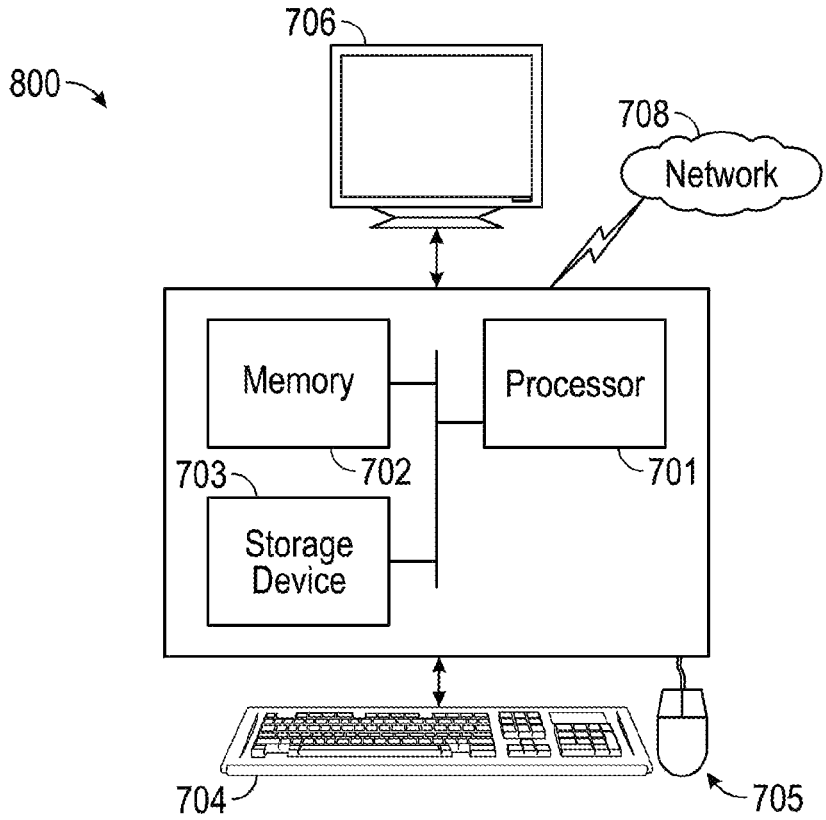
FIG. 8 is a schematic representation of a computer system according to embodiments of the present disclosure.

Embodiments of the present disclosure may be implemented on virtually any type of computer regardless of the platform being used. For example, as shown in FIG. 8, a computer system 700 includes one or more processor(s) 701, associated memory 702 (e.g., random access memory (RAM), cache memory, flash memory, etc.), a storage device 703 (e.g., a hard disk, an optical drive such as a compact disk drive or digital video disk (DVD) drive, a flash memory stick, etc.), and numerous other elements and functionalities typical of today's computers (not shown). In one or more embodiments of the present disclosure, the processor 701 is hardware. For example, the processor may be an integrated circuit. The computer system 700 may also include input means, such as a keyboard 704, a mouse 705, or a microphone (not shown). Further, the computer system 700 may include output means, such as a monitor 706 (e.g., a liquid crystal display (LCD), a plasma display, or cathode ray tube (CRT) monitor). The computer system 700 may be connected to a network 708 (e.g., a local area network (LAN), a wide area network (WAN) such as the Internet, or any other type of network) via a network interface connection (not shown). Those skilled in the art will appreciate that many different types of computer systems exist, and the aforementioned input and output means may take other forms. Generally speaking, the computer system 700 includes at least the minimal processing, input, and/or output means necessary to practice embodiments of the present disclosure.

Further, those skilled in the art will appreciate that one or more elements of the aforementioned computer system 700 may be located at a remote location and connected to the other elements over a network. Further, embodiments of the present disclosure may be implemented on a distributed system having a plurality of nodes, where each portion of the present disclosure (e.g., the local unit at the rig location or a remote control facility) may be located on a different node within the distributed system. In some embodiments, the node corresponds to a computer system. Alternatively, the node may correspond to a processor with associated physical memory. The node may alternatively correspond to a processor or micro-core of a processor with shared memory and/or resources. Further, software instructions in the form of computer readable program code to perform in certain embodiments may be stored, temporarily or permanently, on a computer readable medium, such as a compact disc (CD), a diskette, a tape, memory, or any other computer readable storage device.

The computing device includes a processor 701 for executing applications and software instructions configured to perform various functionalities, and memory 702 for storing software instructions and application data. Software instructions to perform embodiments may be stored on any tangible computer readable medium such as a compact disc (CD), a diskette, a tape, a memory stick such as a jump drive or a flash memory drive, or any other computer or machine readable storage device that can be read and executed by the processor 701 of the computing device. The memory 702 may be flash memory, a hard disk drive (HDD), persistent storage, random access memory (RAM), read-only memory (ROM), any other type of suitable storage space, or any combination thereof.

The computer system 700 is typically associated with a user/operator using the computer system 700. For example, the user may be an individual, a company, an organization, a group of individuals, or another computing device. In one or more embodiments, the user is a drill engineer that uses the computer system 700 to remotely operate managed pressure drilling systems at a drilling rig. The computer system may be programmed to change the setpoint pressure automatically according to the pressure profile as the pump speed changes during a connection.

Advantageously, embodiments disclosed herein may provide for continued bottom hole pressure via operation of back pressure control systems during well operations, including connections. The ability to continue operation of back pressure control systems during connections with a pressure profile table may provide for improved operations during drilling of a wellbore, thus avoiding unwanted pressure deviations and other events that may result in stoppage of drilling or damage to the wellbore and associated equipment.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A managed pressure drilling method comprising:

defining a first drilling plan for a first section of wellbore;

determining a desired drilling pressure for the first section of the first drilling plan; and determining a mud pump speed and a corresponding choke set point to produce the desired drilling pressure for a first segment of the first drilling plan, wherein determining the pump speed and the corresponding choke set point comprises:

a) simulating the mud pump at a first pump speed;

b) recording the corresponding first choke set point to produce the desired drilling pressure;

c) adjusting the mud pump to a second pump speed;

d) recording the corresponding second choke set point to produce the desired drilling pressure; and e) repeating steps c) and d) to generate a table comprising an operation of the mud pump from an off position to a maximum position.

2. The method of claim 1, wherein defining the first drilling plan comprises selecting casing pressure points using offset well parameters.

3. The method of claim 1, wherein determining the desired drilling pressure comprises a pressure within a well stability window of the first drilling plan.

4. The method of claim 1, further comprising:

defining a second drilling plan for a second segment of a wellbore;

determining a desired drilling pressure for the second segment of the second drilling plan; and determining a pump speed and a corresponding choke set point to produce the desired drilling pressure for the second segment of the second drilling plan.

5. A managed pressure drilling method comprising:

drilling a first segment according to a drilling plan for the first segment of a wellbore;

maintaining a near constant bottom hole pressure for the first segment;

operating a choke assembly to provide a back pressure for the first segment;

operating a mud pump to provide a downhole pressure for the first segment; and correlating the downhole pressure to a pump speed for the first segment;

wherein the back pressure substantially comprises the down hole pressure subtracted from the bottom hole pressure and wherein correlating the downhole pressure to a pump speed during a connection to add pipe to a drill string within the first segment comprises following a pump speed to casing pressure table or graph;

wherein the table or graph comprises a pump speed and a corresponding choke set point and determining the table or graph comprises:

a) simulating the pump at a first pump speed;

b) recording the corresponding first choke set point to produce the desired drilling pressure;

c) adjusting the pump to a second pump speed;

d) recording the corresponding second choke set point to produce the desired drilling pressure; and e) repeating steps c) and d) to generate the table comprising an operation of the pump from an off position to a maximum position.

6. The method of claim 5, wherein the choke assembly is operated manually.

7. The method of claim 5, wherein the choke assembly is operated via automatic control.

8. The method of claim 5, further comprising monitoring the pump speed.

9. The method of claim 5, further comprising controlling the pump speed.

10. The method of claim 5, wherein the drilling plan for the first segment of the wellbore is defined by selecting casing pressure points using offset well parameters.

11. The method of claim 5, wherein the desired drilling pressure is determined by a pressure within a well stability window of the drilling plan for the first segment of the wellbore.

12. The method of claim 5, wherein the pump speed and a corresponding choke set point are determined by using a pressure profile.

13. A managed pressure drilling system comprising:

a first sensor for acquiring the bottom hole pressure in a subterranean borehole;

at least one second sensor for acquiring at least one pressure selected from a casing pressure and a drilling pressure;

a third sensor for acquiring a speed of a pump;

a table correlating the drilling pressure to the pump speed for a first segment of a wellbore; and a valve configured to adjust a set point pressure of a choke to adjust a back pressure for adjusting the drilling pressure to approximate the casing pressure, wherein the set point pressure during a connection to add pipe to a drill string within the first segment is obtained by following a pump speed to casing pressure table or graph;

wherein the table or graph comprises the speed of the pump and a corresponding choke set point and determining the table or graph comprises:

a) simulating the pump at a first pump speed;

b) recording the corresponding first choke set point to produce the desired drilling pressure;

c) adjusting the pump to a second pump speed;

d) recording the corresponding second choke set point to produce the desired drilling pressure; and e) repeating steps c) and d) to generate the table comprising an operation of the pump from an off position to a maximum position.

14. The system of claim 13, wherein correlating the casing pressure to the pump speed comprises following the pump speed to casing pressure table or graph.

15. The system of claim 13, wherein the pump speed to casing pressure table or graph is a part of software program.

16. The system of claim 13, wherein adjusting the set point pressure of the choke is via a software program.

* * * * *